United States Patent [19]

Basile

[11] Patent Number: 4,593,344

[45] Date of Patent: Jun. 3, 1986

[54] LIGHT FIXTURE WITH RETAINER

[76] Inventor: Joseph L. Basile, 7258 Hudson Park Dr., Hudson, Ohio 44236

[21] Appl. No.: 685,476

[22] Filed: Dec. 24, 1984

[51] Int. Cl.[4] ..... H01R 33/00

[52] U.S. Cl. ..... 362/226; 362/396; 362/374

[58] Field of Search ..... 362/362, 226, 374, 375, 362/396

[56] References Cited

U.S. PATENT DOCUMENTS

| | | | |
|---|---|---|---|
| 3,177,356 | 4/1965 | Worden | 362/374 |
| 3,676,666 | 7/1972 | White | 362/374 |
| 3,767,912 | 10/1973 | Faux, Sr. | 362/374 |
| 4,031,382 | 6/1977 | Laughter | 362/374 |
| 4,388,679 | 6/1983 | Blaisdell et al. | 362/396 |

*Primary Examiner*—E. Rollins Cross

*Attorney, Agent, or Firm*—Oldham, Oldham & Weber Co.

[57] ABSTRACT

A light fixture for receiving and maintaining parabolic aluminized reflectors. About the periphery of the fixture are a plurality of spring members, each adapted for receiving and maintaining a flange portion of the reflector. The spring members are maintained within the fixture and are deflected outwardly through associated openings in the fixture when the reflector is inserted into place. Removal of the reflector is achieved by a cam bar in engagement with one of the spring members for deflecting the spring member from its engaged position.

9 Claims, 5 Drawing Figures

LIGHT FIXTURE WITH RETAINER

TECHNICAL FIELD

The invention herein resides in the art of light fixtures. More particularly, the invention relates to a can-type fixture including a spring element for securedly receiving a parabolic aluminized reflector.

BACKGROUND ART

The use of a parabolic aluminized reflector (par) as a light source is now well known, particularly in the entertainment industry where such reflectors are commonly used for stage lighting. Typically, such reflectors are maintained in fixtures commonly referred to in the industry as cans because of their can-like appearance. Such fixtures are often referred to as par-cans and will be referred to as such hereinafter. Par-cans are often maintained above a stage or the like where access is difficult and, if not done with care, dangerous.

Presently known par-cans are such that a par lamp or bulb rests on a circumferential ledge inside the can and is held thereagainst by a spring ring or finger extending from an end cap. Changing the lamp or bulb in such a fixture is difficult, generally requiring the use of both hands of the operator. When done at heights, the bulb changing operation can be dangerous since the operator must release his grip of the ladder or safety rail to effect the bulb change. Further, with the prior art devices, the changing operation is inordinately time consuming.

It is has also been found that prior art par-cans allow the bulb maintained therein to jar loose or dislodge either in shipment or in use. Such failure by dislodgment is both annoying and costly.

DISCLOSURE OF INVENTION

In light of the foregoing, a first aspect of the invention is the provision of a par-can having spring biased retainers.

Another aspect of the invention is the provision of a par-can having spring biased retainers which are easily and quickly engaged and disengaged by an operator.

Yet another aspect of the invention is the provision of a par-can having retainers that allow for one-handed removal and replacement of the bulb or lamp.

Still a further aspect of the invention is the provision of a par-can having a bulb retainer which is not given to dislodgment.

Still a further aspect of the invention is the provision of a par-can which is easy to construct, reliable and durable in operation, and cost effective.

The foregoing and other aspects of the invention which will become apparent as the detailed description proceeds are achieved by a light fixture for maintaining a lamp therein, comprising: a body member for receiving and housing the lamp, said body member having a plurality of openings about the periphery thereof; and a plurality of securing means affixed to said body member, one associated with each said opening, for making securing engagement with the lamp.

Other aspects of the invention are attained by a light fixture for maintaining a lamp, comprising: a body member having a plurality of openings about a periphery thereof; and a plurality of elongated members, one associated with each said opening, each said elongated member being affixed at a first end thereof to said body member, and having a retainer portion extending through an associated one of said openings.

DESCRIPTION OF DRAWINGS

For a complete understanding of the objects, techniques, and structure of the invention reference should be had to the following detailed description and accompanying drawings wherein.

DETAILED DESCRIPTION OF PREFERRED EMBODIMENT

Figure 1:
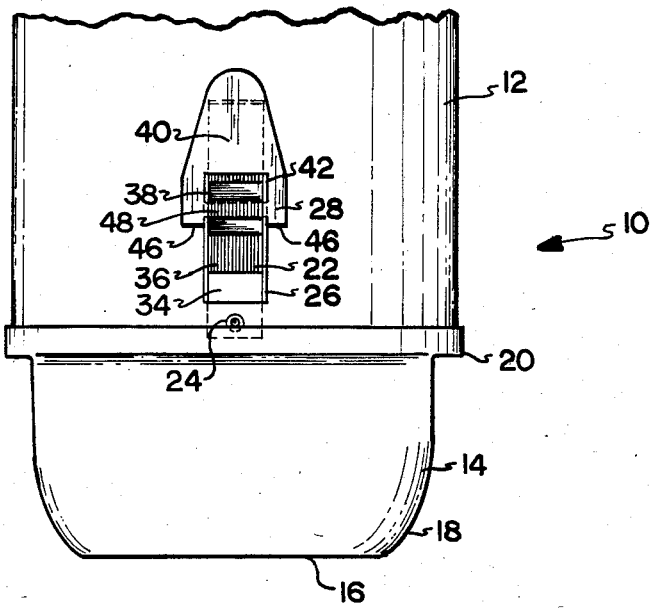
FIG. 1 is a side perspective view of a par-can according to the invention.
Figure 2:
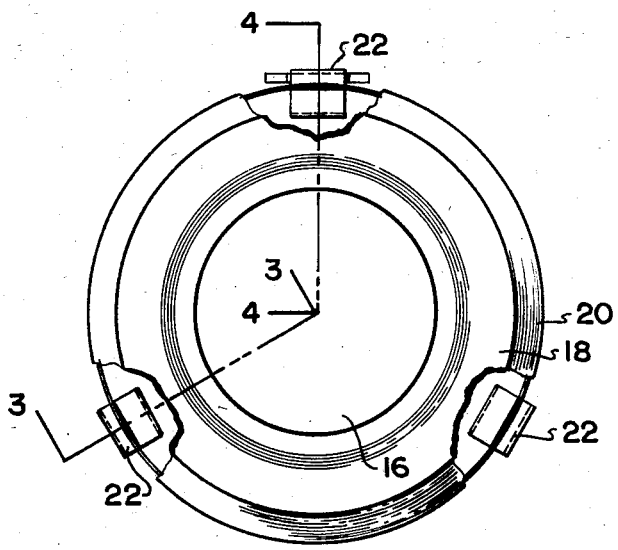
FIG. 2 is an end perspective view of the par-can of FIG. 1.

Referring now to the drawings and more particularly FIGS. 1 and 2, it can be seen that a light fixture or par-can used for receiving and maintaining a parabolic aluminized reflector is designated generally by the numeral 10. The fixture or can 10 includes a tubular body 12 which is open at one end (not shown) through which the light from the reflector may be emitted. A cap or other suitable cover 14 closes the other end of the can 10 in standard fashion. The cap 14 has a flat end 16 and a slightly curved side portion 18 as shown. A rim 20 is adapted to fit over the end of the tubular body section 12 as best shown in FIG. 1. Typically, the cap 10 will be received by the tubular body 12 by means of a snap fit, friction fit, or threaded engagement. Suffice it to say that suitable means are provided for allowing engagement of the rim 20 with the end of the body member 12.

A plurality of spring members 22 are preferably evenly spaced about an end portion of the tubular body 12 for purposes of receiving and maintaining a parabolic aluminized reflector in a method to be described hereinafter. While any number of spring members 22 may be so provided, it is preferred that three such spring members be included for stable maintenance of the reflector.

As shown in the drawings, rivets 24 or other suitable fastening means are adapted for securing the spring members 22 to the tubular body 12. The spring members 22 are received within the tubular body 12 and span a uniquely associated slotted opening 26. As shown, the openings 26 are wider, but shorter than the spring members 22 so that a portion thereof can expand or flex therethrough. A release cam bar 28 is associated with at least one of the spring members 22 for purposes of deflecting the spring member 22 and allowing release of the reflector in a manner to be described hereinafter.

Figure 3:
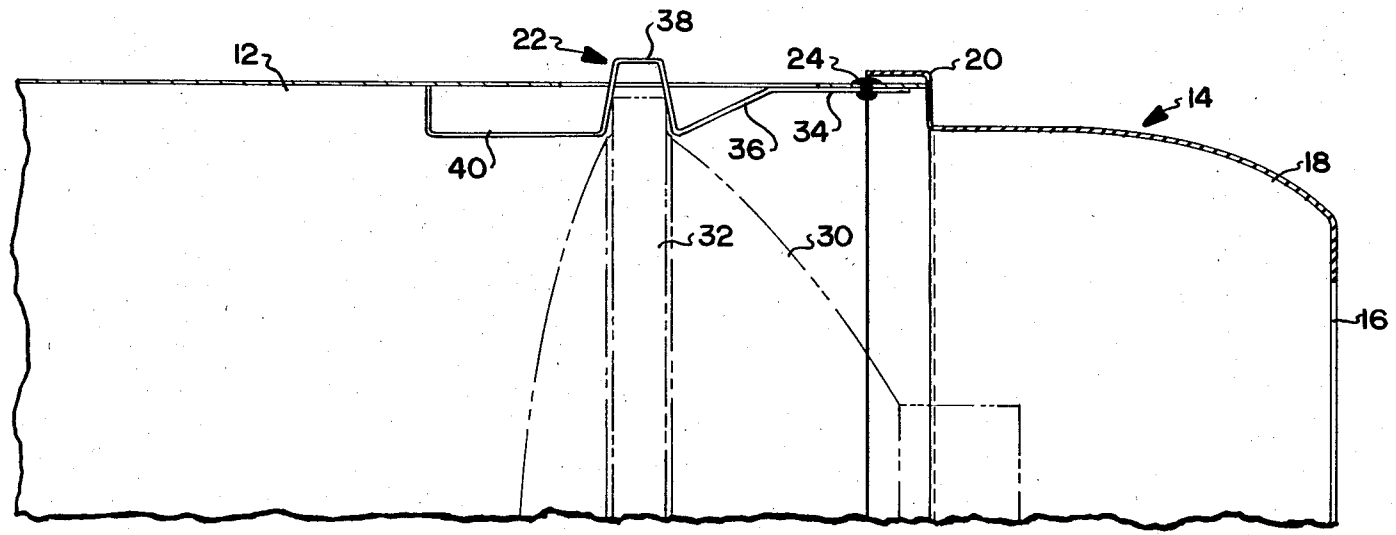
FIG. 3 is a sectional view of the par-can of FIG. 2 taken along the lines 3—3.
Figure 4:
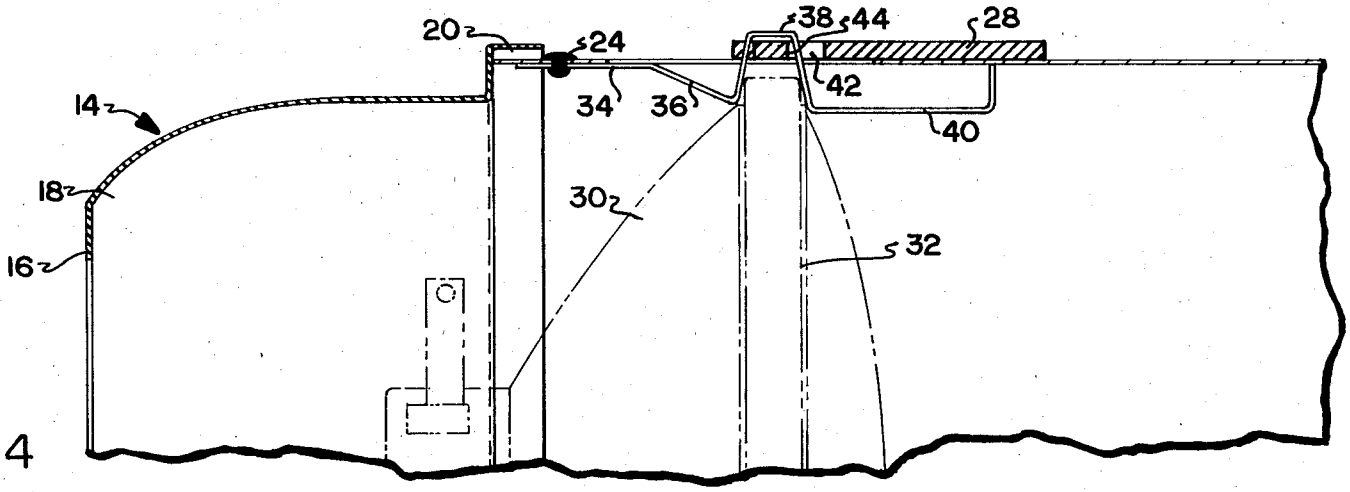
FIG. 4 is a sectional view of the par-can of FIG. 2 taken along the lines 4—4.

As shown in FIGS. 3 and 4, a parabolic aluminized reflector 30 is received by the can 10 with the end thereof covered by the cap 14. The end which is so covered is that which has the connectors thereon for making electrical connection with a suitable power source. A flange 32 circumferentially extending about the reflector 30 is received by each of the spring members 22 to be fixedly maintained thereby.

With particular reference now to the spring member 22, it can be seen that such member includes a flat linear portion 34 which lays against the inner surface of the body member 12 and is appropriately secured by means of the rivet 24. This flat linear portion 34 extends to the opening 22. An angled portion 36, oblique with the linear portion 34, extends inwardly of the tubular member 12 as shown in FIGS. 3 and 4. The retainer portion 38 is connected to the angled portion 36 and is U-shaped or hat-shaped for purposes of receiving the flange 32. As noted, the sides of the retainer portion 38 are angled slightly such that the closed end of the portion 38 is smaller than the open end, to assure tight contacting engagement between the sidewalls thereof and the flange 32. The end portion 40, connected to the retainer portion 38 is L-shaped, with the short end of the "L" being in contacting engagement with the inner surface of the tubular body 12. However, the end portion 40 is not affixed to the inner surface of the tubular body 12, but is free to move therealong as the spring member 22.

The spring members 22 are preferably resilient, constructed of spring steel or a resilient plastic. The retainer portion 38 extends upwardly through the slotted opening 26. Accordingly, the spring member 22 may be deflected such that the retainer portion 38 moves outwardly through the opening 26, but with such retainer portion always being biased inwardly, by the contacting engagement of the end portions 34, 40 with the inner surface of the tubular member 12.

It will now be appreciated that with three such spring members 22 positioned about the periphery of the tubular body 12, a reflector 30 may be easily inserted into secured engagement with the retainer portions 38 of such spring members. With the cap 14 removed, the reflector or lamp 30 may simply be pushed axially into the tubular body 12, with the flange 32 contacting the angled portions 36, deflecting the spring members by urging the retainer portion 38 through the associated opening 26. When the flange portion 32 has passed beyond the apex of interconnection between the angled portion 36 and retainer portion 38, the spring members 32 snap into place with the flange 32 being secured by the inner walls of the retaining portion 38. As can be seen, placement of the bulb or reflector 30 may be achieved with a one hand operation and, once in place, it is secured by the plurality of spring members.

Figure 5:
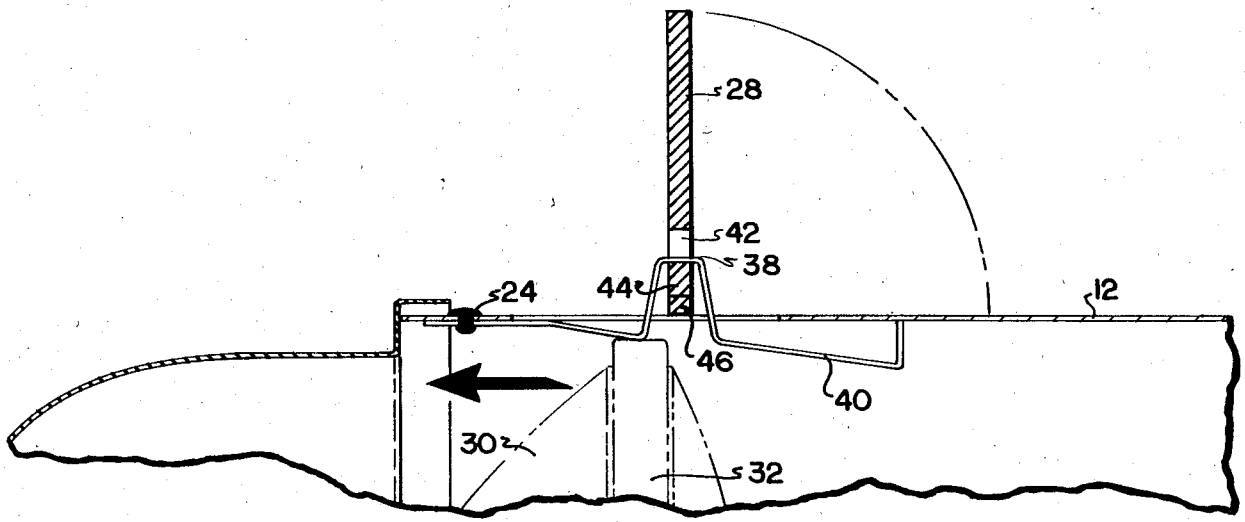
FIG. 5 is a sectional view of the par-can of the invention showing the operation of the release cam bar for releasing the spring clip of the invention.

Removal of the reflector 30 is as easily accomplished. For this purpose, the release cam bar 28 is provided in association with at least one of the spring members 22. The cam bar 28 has a window 42 therein through which passes the retainer portion 38 of the spring member 22. A cam surface 44 defines a bottom edge of the window 42 and is adapted for making contacting engagement with the retainer portion 38. The distance between the end surface 46 of the release cam bar 28 and the cam surface 44 is greater than the distance separating the inner top surface of the retainer portion 38 and the outer surface of the tubular body 12 when the spring member 22 is in engagement with the flange 32 as shown in FIG. 4. When the release cam bar 28 is lifted from the side of the tubular body 12 as shown in FIG. 5, the cam surface 44 urges against the upper surface of the retainer portion 38 and draws the retainer portion through the opening 26 to substantially flatten the angled portion 36 against the inner wall of the tubular body 12. This releases the flange 32 from the retainer portion 38, allowing the operator to then simply lift the flange 32 from the retainer portions 38 of the remaining spring members 22. It will be apparent to those skilled in the art that the ends 46 of the release cam bar 28 span the opening 26 and that the ends are spaced sufficiently from the cam surface 44 to achieve a total release of the flange 32.

It should now be apparent that release and removal of the lamp or reflector 32 is a simple matter, being a one-handed operation, as was the placement of the lamp. The lamp is stable and secure, and since the spring members 22 are maintained within the tubular body 12, they are not susceptible to external forces.

Thus it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be had to the following claims.

What is claimed is:

1. A light fixture for maintaining a lamp therein, comprising:

a body member for receiving and housing the lamp, said body member having a plurality of openings about the periphery thereof;

a plurality of securing means affixed to said body member, one associated with each said opening, for making securing engagement with the lamp, each said securing means comprising an elongated member having first and second ends, each such end engaging an inner surface of said body member on opposite sides of an associated one of said openings, said first end being affixed to said body member and said second end being movable upon said body member, said elongated member including a retainer portion extending through said associated opening; and a cam bar associated with one said elongated member, said cam bar being interposed between an outer surface of said body member and said retainer portion.

2. The light fixture according to claim 1 wherein said elongated member includes an intermediate portion extending between said first end and said retainer portion, said intermediate portion being oblique to said first end.

3. The light fixture according to claim 2 wherein said second end is L-shaped.

4. The light fixture according to claim 3 wherein said elongated member is resilient.

5. The light fixture according to claim 1 wherein said cam bar has a window therein receiving said retainer portion of said elongated member.

6. The light fixture according to claim 5 wherein said cam bar spans said associated opening in said body member.

7. A light fixture for maintaining a lamp, comprising:

a body member having a plurality of openings about a periphery thereof;

a plurality of elongated members, one associated with each said opening, each said elongated member being affixed at a first end thereof to said body member, and having a retainer portion extending through an associated one of said openings, said elongated members being maintained within said body member, a second end of said elongated member being in movable contacting engagement with an inner surface of said body member, said first end angling inwardly of said body member to said retainer portion; and cam means in selective forceful engagement with said retainer portion for deflecting said elongated member toward said inner surface of said body member.

8. The light fixture according to claim 7 wherein said elongated member is of resilient material.

9. The light fixture according to claim 7 wherein said cam means comprises a bar having a window therein receiving said retainer portion, a bottom periphery of said window comprising a cam surface for making said forceful engagement with said retainer portion.

* * * * *